US007395647B2

(12) United States Patent
Hense

(10) Patent No.: US 7,395,647 B2
(45) Date of Patent: Jul. 8, 2008

(54) SADDLE PAD DISPLAY SYSTEM AND METHOD

(76) Inventor: Martha L. Hense, 124 Riverlake Dr., Woodstock, GA (US) 30188

( * ) Notice: Subject to any disclaimer, the term of this patent is extended or adjusted under 35 U.S.C. 154(b) by 403 days.

(21) Appl. No.: 11/292,924

(22) Filed: Dec. 2, 2005

(65) Prior Publication Data

US 2007/0125047 A1 Jun. 7, 2007

(51) Int. Cl.
*B68C 1/12* (2006.01)

(52) U.S. Cl. ..... 54/66; 54/76

(58) Field of Classification Search ..... 54/44.1, 54/65, 66, 76, 78; 2/246; 40/1.5, 315
See application file for complete search history.

(56) References Cited

U.S. PATENT DOCUMENTS 314,821 A * 3/1885 Fonteine ..... 54/65
497,255 A * 5/1893 Schroeder ..... 54/66
721,653 A * 3/1903 Amos ..... 54/66
2,072,188 A * 3/1937 Tauber ..... 54/66
4,604,856 A * 8/1986 Schneider et al. ..... 54/76
5,575,139 A * 11/1996 Green ..... 54/66
D376,226 S 12/1996 Podolny
5,926,920 A * 7/1999 Denison ..... 24/13
6,065,273 A 5/2000 Schneider
6,125,616 A * 10/2000 Brown ..... 54/66

* cited by examiner

*Primary Examiner*—Rob Swiatek
(74) *Attorney, Agent, or Firm*—Clements Bernard Miller; Christopher L. Bernard; Lawrence A. Baratta, Jr.

(57) ABSTRACT

A saddle pad display system by which a horse and rider may display an exhibitor number tag, equine jewelry, or the like on a saddle pad. The saddle pad display system is comprised of: a saddle pad, the saddle pad having a left side and a right side and further having an outer pad surface and an inner pad surface; a plurality of display holes cut and sewn into the saddle pad, the depth of the display holes continuing throughout the entire thickness of the saddle pad; a retaining sleeve attached to the inner pad surface and located centrally between a pair of display holes located on each side of the saddle pad; and a display item, the display item having a clip by which the display item may be securely attached to the saddle pad.

17 Claims, 9 Drawing Sheets

SADDLE PAD DISPLAY SYSTEM AND METHOD

FIELD OF THE INVENTION

The present invention relates generally to the field of equine tack. More specifically the present invention relates to a saddle pad display system and an associated method of manufacture with which a user may display an exhibitor number in a horse show or other competition or display equine jewelry, such as, but not limited to, a breed logo; a horse, stable, or owner name; or a monogram.

BACKGROUND OF THE INVENTION

Several circumstances exist under which a horse owner or horse rider may wish to display an item on the tack of his or her horse. For example, displays may be needed or desired for competition in horse shows or exhibitions. Additionally, there is an increasing trend among horse owners and riders to display equine jewelry, representing perhaps a breed logo or a horse or owner name, a monogram, or any decorative design.

An exhibitor or contestant at a horse show receives an exhibitor number tag upon entry into the competition or show. For example, throughout this disclosure and associated drawing figures, the entry number 341 is used on an exhibitor number tag. Such a number identifies both horse and rider in a competition. All scoring by judges is based not on a rider name or a horse name, but rather is based on and recorded by the number printed on the exhibition number tag and displayed on either the horse or the back of the rider. These exhibitor number tags are typically comprised of a number printed on a heavy paper or a cardstock. Some exhibitor number tags are available with pin holes and/or a metal clip located on the back. Depending on the saddle class in which the rider is competing, the exhibitor number tag may be displayed on each side of the horse by pinning it to the saddle pad, saddle blanket, or bridle.

Several concerns exist with the methods currently available for displaying exhibitor number tags. For those placed on the bridle of a horse, the horse may experience discomfort, limited vision, or annoyance at the presence of the exhibitor number tag. For those placed on a saddle pad or saddle blanket, via a means of pinning or otherwise, the exhibitor number tag may flap and cause disturbances for the rider and/or the horse. Additionally, a judge may find it difficult to clearly observe and read a number on the exhibitor number tag if it is freely moving about on the surface to which it is pinned or attached.

A display need exists not only for horse shows and competitions, but also a display need or desire exists to show equine jewelry.

An increasing trend is developing in which horse owners and/or riders wish to display equine jewelry on a horse. Such equine jewelry may include a breed logo; a horse, owner, or stable name; a monogram; or any decorative design. For example, in regard to breed logos, the owner of a Dutch Warmblood may wish to display equine jewelry on the horse tack that is in the shape and form of a standing and roaring lion placed upon a roughly pentagon-shaped shield. Or perhaps the owner of a Swedish Warmblood may wish to display a block-letter "S" with a crown placed upon the top of the "S". Breed logos are well known in the equine field. Jewelers are incorporating these breed logos into various jewelry pieces that can be displayed on the tack of a horse or elsewhere.

In the prior art, some devices have been disclosed for displaying a number used by a competitor in a horse show. Many such devices still require that the exhibitor number tag be attached via a means of pinning the tag to a saddle pad or clipping it to the bridle worn by the horse, for example. Such devices may be uncomfortable or distracting to the rider or to the horse. In fact, a horse or rider might actually be stuck by a pin while the pinning process is taking place. Furthermore, such devices may not enable a judge to easily and clearly view the number associated with a particular horse and rider.

However, while such devices may be suitable for their particular purposes, they are not suitable for the purposes of the present invention. Therefore, a need exists for a saddle pad display system as is disclosed in the present invention.

These and other problems exist. Previous attempts to solve these and other problems include the following:

U.S. Pat. No. 6,065,273, issued to Schneider on May 23, 2000, discloses a contour English saddle pad having a rear area that is sufficient in size to accommodate an exhibitor number on each side of the pad. Preferably, the rear area of each side of the pad comprises a transparent or translucent, preferably non-glare plastic pocket, into which a card printed with the exhibitor number may be easily inserted and removed. The saddle pad of the invention allows display of the exhibitor number on each side of the horse without detracting from the presentation of the horse and is especially useful in English classes in which conformation is a judging criterion. A major benefit of the saddle pad of the invention, especially in English classes in which multiple horses are exhibited simultaneously, is that the exhibitor's number is continuously displayed within the same field of vision in which the judge evaluates the movement and conformation of the horse, thereby eliminating viewing problems associated with the traditional wearing of the exhibitor number on the rider's back. This disclosed invention, however, may result in the plastic discoloring or cracking over time.

U.S. Design Patent No. Des. 376,226, issued to Podolny on Dec. 3, 1996, discloses the ornamental design for a horse saddle pad with speakers and pockets for carrying a portable cassette or disc player. This disclosed invention, however, is not allowable in competition.

Additionally, there are several products in the marketplace that seek to provide a saddle pad with a competition exhibit entry number. For example, Chick's Discount Saddlery retails a competition fleece pin-on saddle pad, available online at http://www.chicksaddlery.com/Merchant2/merchant.mvc?Product_Code=22P35&Screen=PROD. Yet another example from Texas Equine Saddlery is the English saddle pad with a translucent display number pocket attached on each side of the saddle pad with Velcro® fasteners. This English saddle pad product with display number pockets is available online at http://www.horseselectsales.com/halter-s.htm.

While these patents and other previous devices and methods have attempted to solve the above mentioned problems, none have provided for a saddle pad display system in the same manner as the present invention. Therefore, a need exists for such a device and method of manufacture.

BRIEF SUMMARY OF THE INVENTION

In various embodiments, the present invention provides a new and useful saddle pad display system. A saddle pad display system is used in order to display an exhibitor number in a horse show or other competition or to display equine jewelry, such as, but not limited to, a breed logo, a horse or stable name, a monogram, or any decorative design.

In one exemplary embodiment, the present invention discloses a saddle pad display system by which a horse and rider may display an exhibitor number tag, equine jewelry, or the like on a saddle pad display system comprised of: a saddle pad, the saddle pad having a left side and a right side and further having an outer pad surface and an inner pad surface; a plurality of display holes cut and sewn into the saddle pad, the depth of the display holes continuing throughout the entire thickness of the saddle pad; a retaining sleeve attached to the inner pad surface and located centrally between a pair of display holes located on each side of the saddle pad; and a display item, the display item having a clip by which the display item may be securely attached to the saddle pad.

In another exemplary embodiment of the present invention, the saddle pad display system is manufactured such that there is only one display hole located on each side of the saddle pad.

A primary advantage of the present invention is that the saddle pad display system may be used to allow a competitor to enter a horse show and easily display the exhibitor number tag so that the judges may clearly see the number and such that neither the rider nor the horse is disturbed or harmed by the exhibitor number tag.

Another advantage of the present invention is that the saddle pad display system places the exhibit number tag on the saddle pad in such a manner that the exhibit number tag does not flap with horse movement and therefore prevent a judge from easily reading the competitor's number.

Yet another advantage of the present invention is the ease of use which a rider may place an exhibitor number tag or piece of equine jewelry into the saddle pad display system through the display holes. The clip located on the back of the exhibitor number tag or piece of equine jewelry can be easily slipped into place through the display holes and retaining sleeve without the bother and delay of working with pins.

BRIEF DESCRIPTION OF THE DRAWINGS

The present invention is illustrated and described herein with reference to preferred embodiments and examples thereof, in which like reference numbers denote like parts or components, and in which.

DETAILED DESCRIPTION OF THE INVENTION

Before explaining the disclosed embodiments of the present invention in detail, it is to be understood that the invention is not limited in its application to the details of the particular arrangement shown since the invention is capable of other embodiments. Also, the terminology used herein is for the purpose of description and not of limitation.

Figure 1:
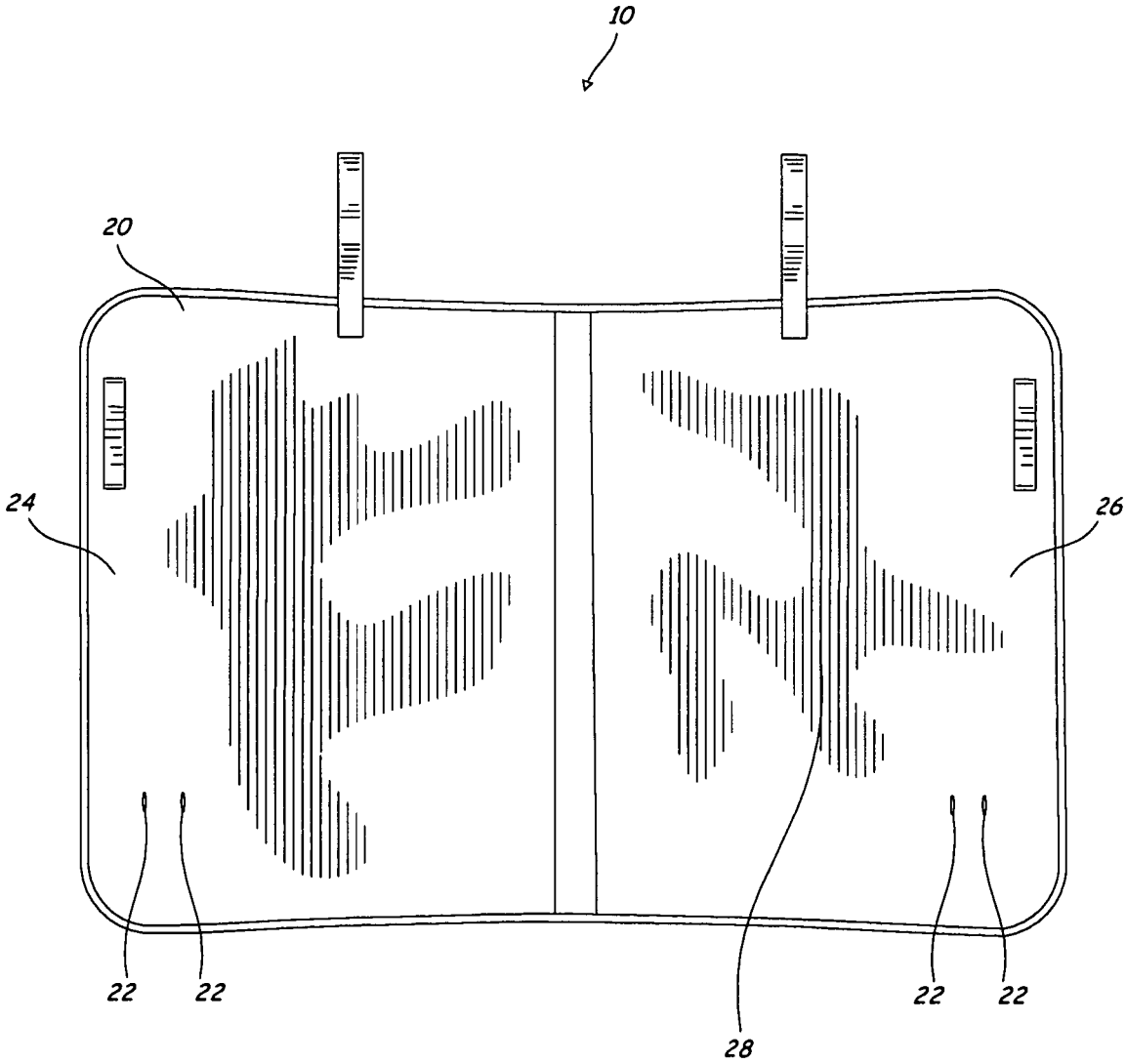
FIG. 1 is a top view of a saddle pad display system according to an embodiment of the present invention.

Referring now to FIG. 1, a top view of a saddle pad display system 10 is shown. The saddle pad display system 10 is shown with a saddle pad 20 having a left side 24 and a right side 26. The saddle pad 20 is shown further with the outer pad surface 28. A display hole 22, used to securely hold display items, is located in pairs, two on the saddle pad left side 24 and two on the saddle pad right side 26.

The saddle pad 20, inner pad surface 30, and outer pad surface 28 may be manufactured from various materials or fabrics such as cotton or fleece. The display holes 22 may be located in varying places on the saddle pad 20; however, such placement must allow for clear visibility of the exhibitor number tag 40 by a judge. Although the present invention is shown with a pair of display holes 22 located on each side of the saddle pad 20, the saddle pad display system 10 may be manufactured such that only one display hole 22 exists on each side of the saddle pad 20. A pair of display holes 22 on either side of the saddle pad 20 may be located in varying distances apart from one another, so long as a display item may securely be placed into both of the displays holes, such that both display holes 22 are used simultaneously to hold one exhibitor number tag 40. In the present invention, the display holes 22 on one side are shown a distance of approximately one and one half inches apart from one another.

Figure 2:
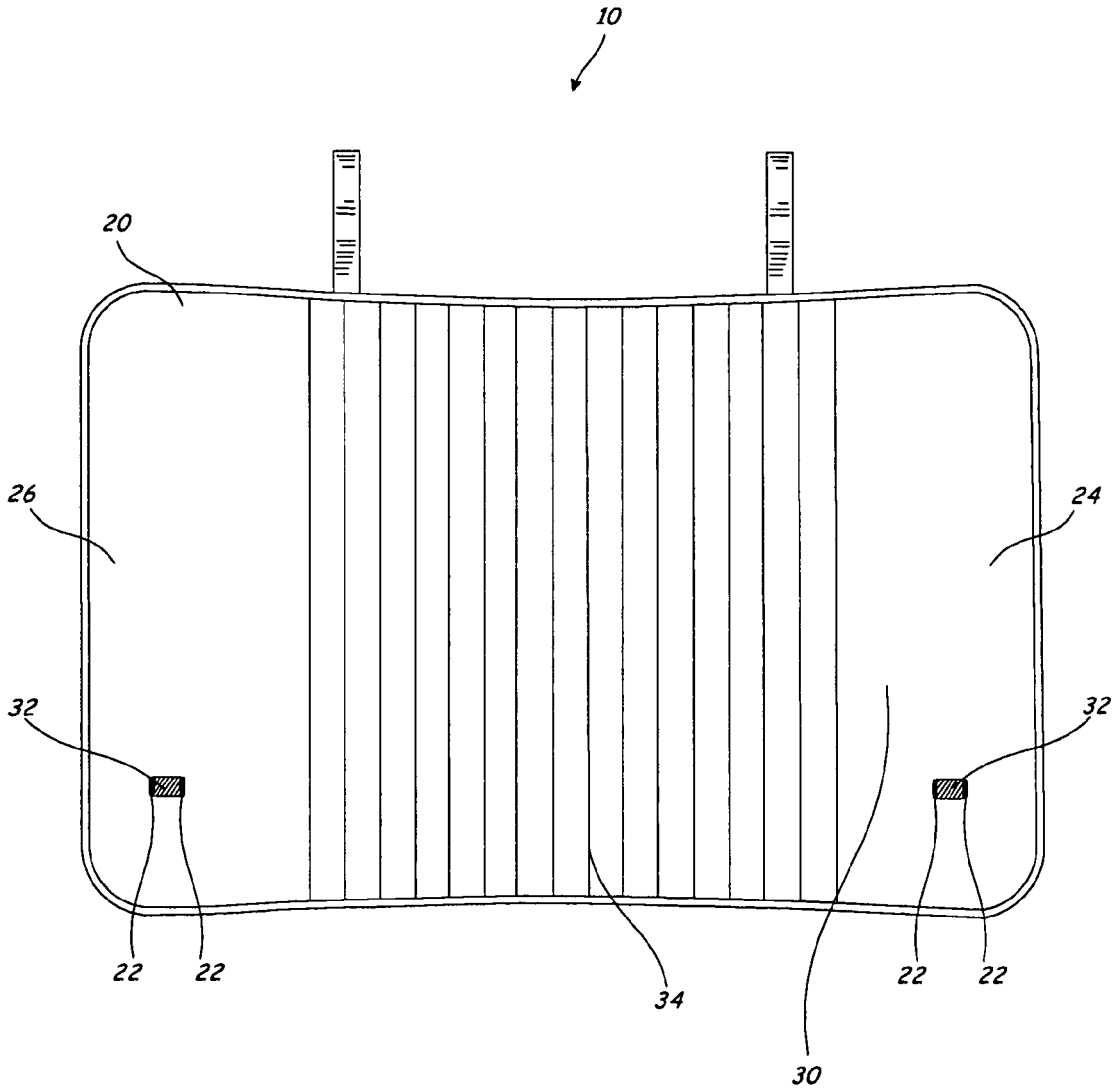
FIG. 2 is a bottom view of a saddle pad display system according to an embodiment of the present invention.

Referring now to FIG. 2, a bottom view of a saddle pad display system 10 is shown. The saddle pad display system 10 is shown, from the under side, with a saddle pad having a left side 24 and a right side 26, as illustrated in FIG. 1. However, because FIG. 2 is a bottom view, the right and left sides of the saddle pad 20 are reversed as illustrated when compared to FIG. 1, making the left side 24 appear of the right side of the page and the right side 26 appear on the left side of the page in FIG. 2. The saddle pad 20 is shown further with the inner pad surface 30 and a fleece underside 34 to provide additional padding and comfort between a horse and its rider. Display holes 22, used to securely hold display items, are located in pairs, two on the saddle pad 20 left side 24 and two on the saddle pad 20 right side 26. The display holes 22 are sewn through the entire thickness of the saddle pad 20, including the outer pad surface 28, the fiber filling, and the inner pad surface 30. Located between each pair of display holes 22 is a retaining sleeve 32. The retaining sleeve 32 is used to cover the metal clip of an exhibitor number tag or a piece of equine jewelry and to protect the body of the horse on which the saddle pad 20 sits from unnecessary poking or scraping by the metal clip. The retaining sleeve 32 may be manufactured from various materials or fabrics such that the retaining sleeve maintains its strength to properly contain a metal clip.

Figure 3:
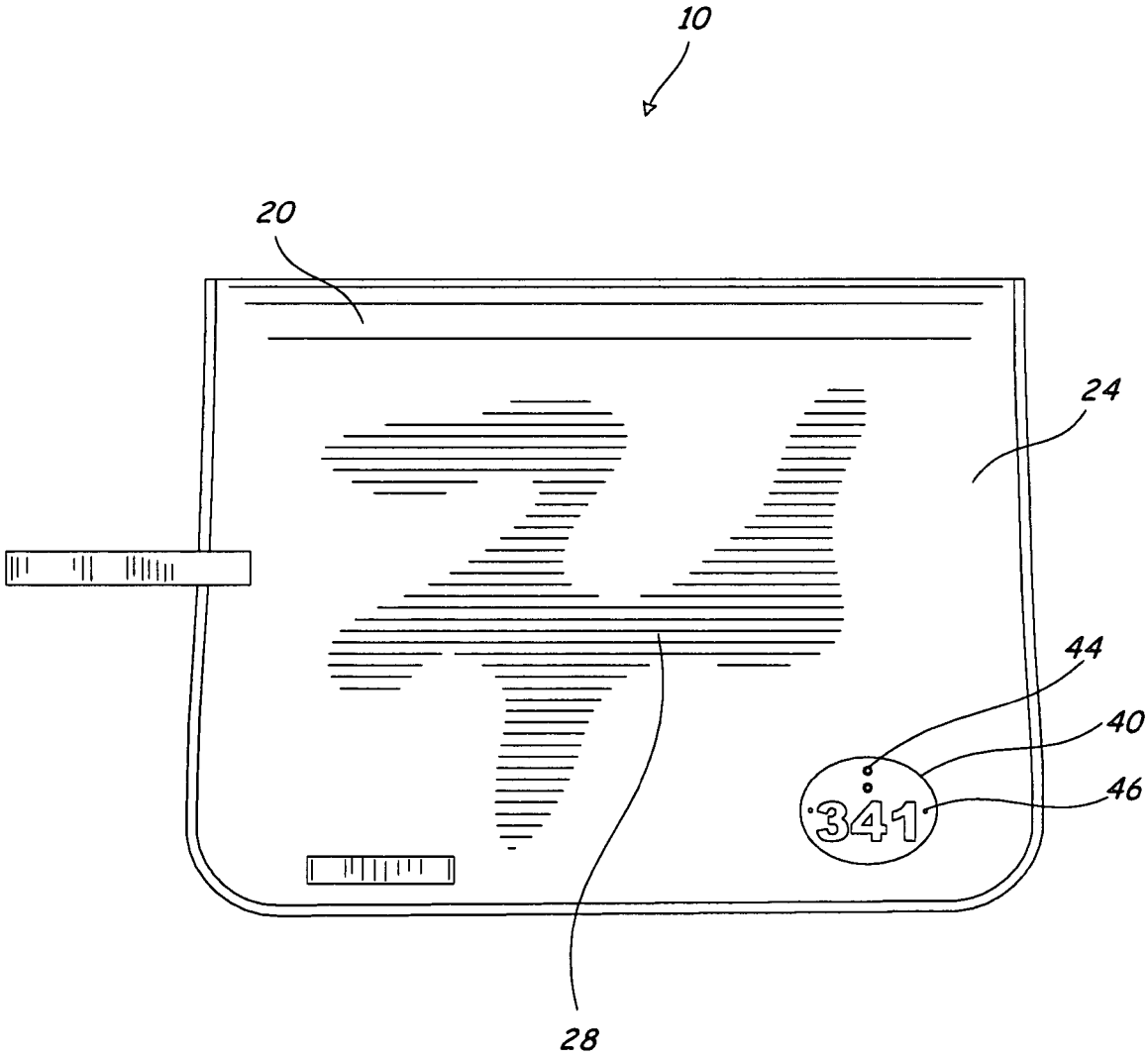
FIG. 3 is a left side view of a saddle pad display system according to an embodiment of the present invention.

Referring now to FIG. 3, a left side view of a saddle pad display system 10 is shown. The saddle pad display system 10 is shown with a saddle pad 20 from the view of its left side 24. The outer pad surface 28 of the saddle pad 20 is also shown. The saddle pad display system 10 is illustrated showing the saddle pad 20 displaying an exhibitor number tag 40. The exhibitor number tag 40 exists already in the art. It is commonly used at equine competitions to give each rider and horse a unique number with which to compete. Visible from the front view of an exhibitor number tag 40 in this figure are two metal clip grommets 44 and two pin holes 46. The metal clip grommets 44 extend through the entire thickness of the exhibitor number tag 40 and securely hold a metal clip to the backside of the exhibitor number tag 40. The pin holes 46 are pre-punched into the exhibitor number tag 40 for those exhibitors who wish to use the cumbersome effort of using safety pins or the like to pin an exhibitor number tag 40 to each side of the saddle pad 20. The pin holes 46 are shown for illustrative purposes only and are not a component of the present invention.

Figure 4:
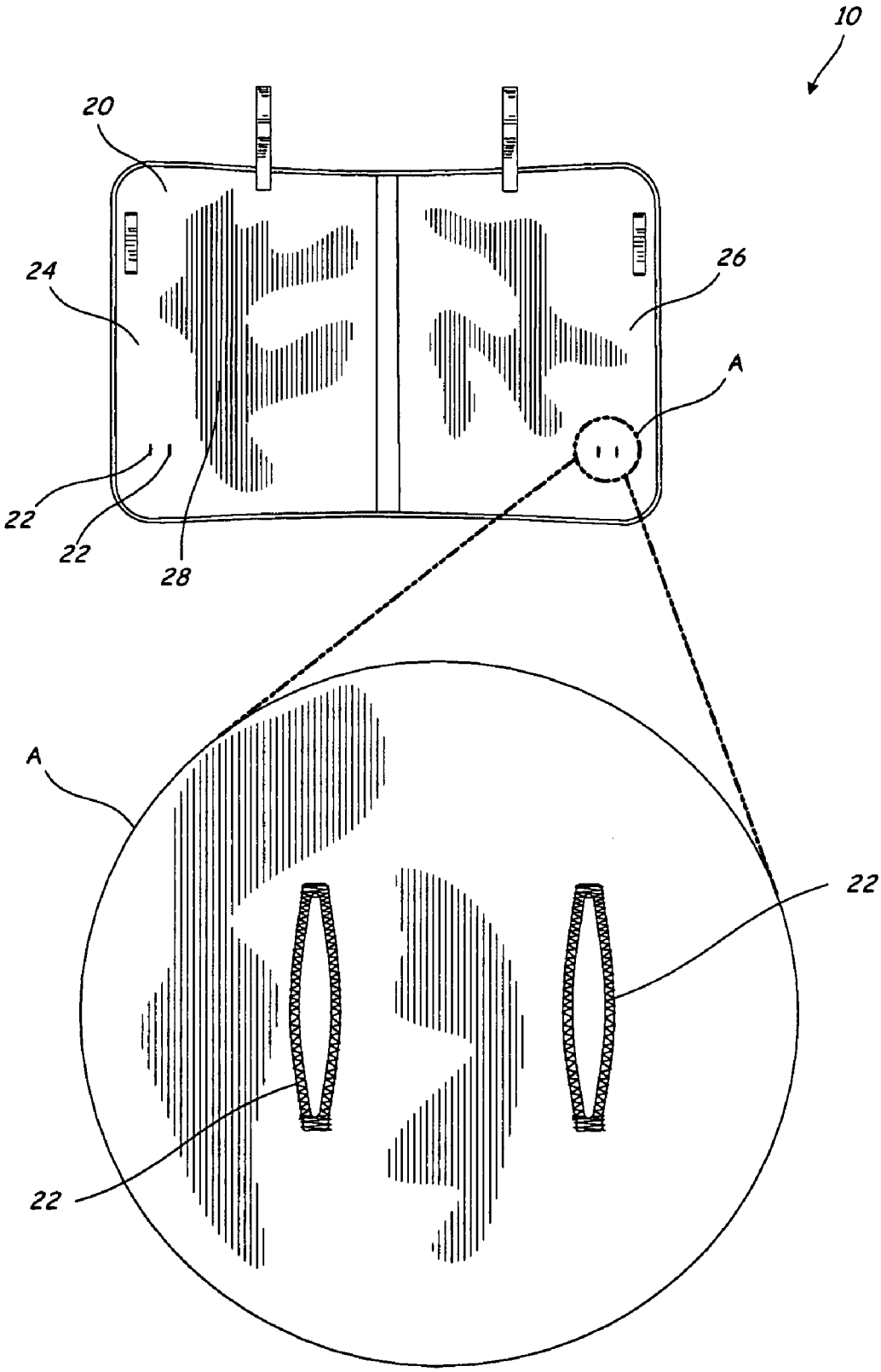
FIG. 4 is a top view of a saddle pad display system according to an embodiment of the present invention.

Referring now to FIG. 4, a top view of a saddle pad display system 10 is shown, including an enlarged area view A of display holes 22 located on one side of the saddle pad 20. The saddle pad display system 10 is shown with a saddle pad 20 having a left side 24 and a right side 26. The saddle pad 20 is shown further with the outer pad surface 28. A display hole 22, used to securely hold display items, is located in pairs, two on the saddle pad 20 left side 24 and two on the saddle pad 20 right side 26. The display holes 22 are cut such that they extend through the entire thickness of the saddle pad 20. The enlarged area view A illustrates the display holes 22 and the stitching that securely holds the outer pad surface 28, fiber filling, and inner pad surface in place. The stitching along the circumference of the display hole 22 is strong and secure such that it will endure repeated use of placing various display items in them. The stitching along the circumference of the display hole 22 may be of any stitching pattern known in the art of sewing, so long as the integrity of the display holes 22 is firmly maintained.

Figure 5:
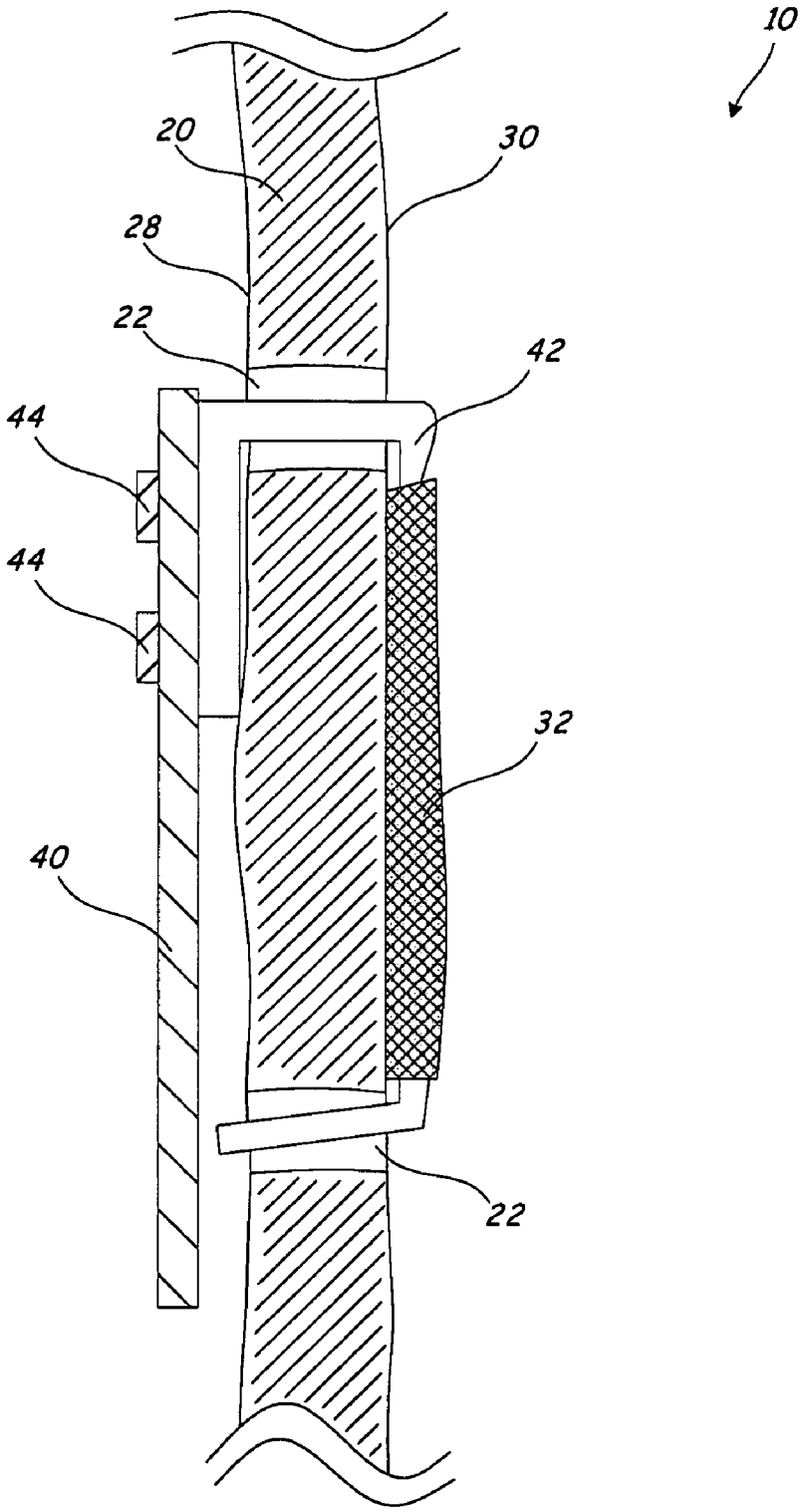
FIG. 5 is a side sectional view of a saddle pad display system according to an embodiment of the present invention.

Referring now to FIG. 5, a side sectional view of a saddle pad display system 10 is shown. The side sectional view of the saddle pad 20 is shown with the outer pad surface 28, the inner pad surface 30, and two display holes 22. In this view, the saddle pad display system 10 is shown accommodating an exhibitor number display 40. The exhibitor number display 40 includes two metal clip grommets 44 which extend through the entire thickness of the exhibitor number tag 40 and securely hold a metal clip 42 to the backside of the exhibitor number tag 40. The metal clip 42 is inserted into the saddle pad 20 through the display hole 22 on the upper portion of the saddle pad 20 shown. The metal clip 42 is passed through this display hole 22 from the outer pad surface 28 and into the retaining sleeve 32, located on the inner pad surface 30. As the metal clip 42 exits the bottom end of the retaining sleeve 32 it is placed through a display hole 22 on the lower portion of the saddle pad 20 and passes through from the inner pad surface 30 out to the outer pad surface 28 and up against the back of the exhibitor number tag 40. The retaining sleeve 32 is sewn into the inner pad surface 30 such that it can securely hold the metal clip 42 is it is passed through. The same metal clip 42 is used on other displays items as well. For example, whether the display item is equine jewelry in the form of a breed logo, monogram, stable name, horse owner name, or the like, the metal clip 42 attaches to the back of the piece of equine jewelry by the means of gluing, or another method of adhesion or attachment, and is passed through the saddle pad 20, its display holes 22, and the retaining sleeve 32.

Figure 6:
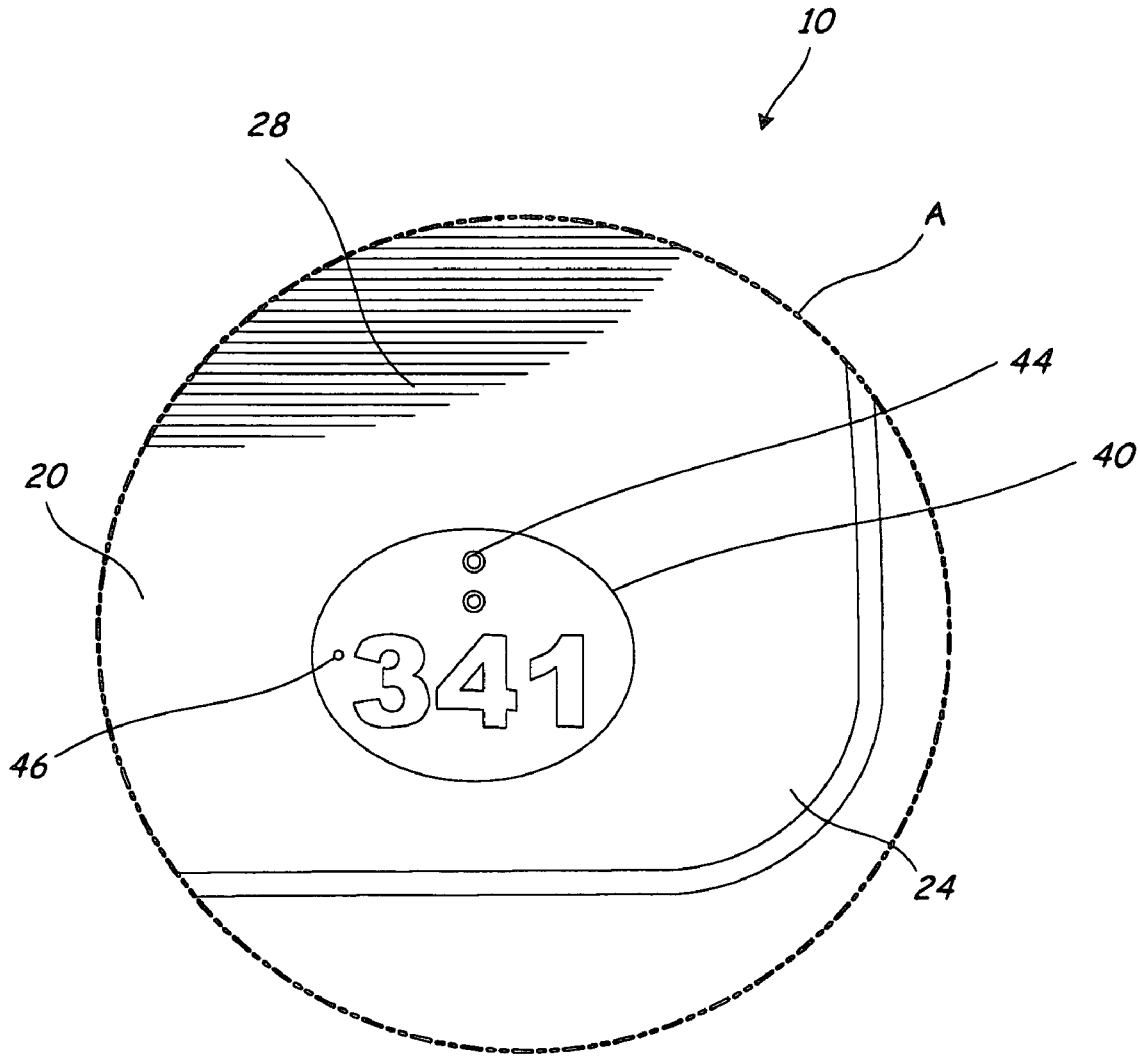
FIG. 6 is a left side view of a saddle pad display system according to an embodiment of the present invention.

Referring now to FIG. 6, a left side view of a saddle pad display system 10 is shown. The saddle pad 20 is shown close up in view A. The saddle pad 20 is shown from the left side 24, displaying the outer pad surface 28, an exhibitor number tag 40, a metal clip grommet 44, and a pin hole 46.

Figure 7:
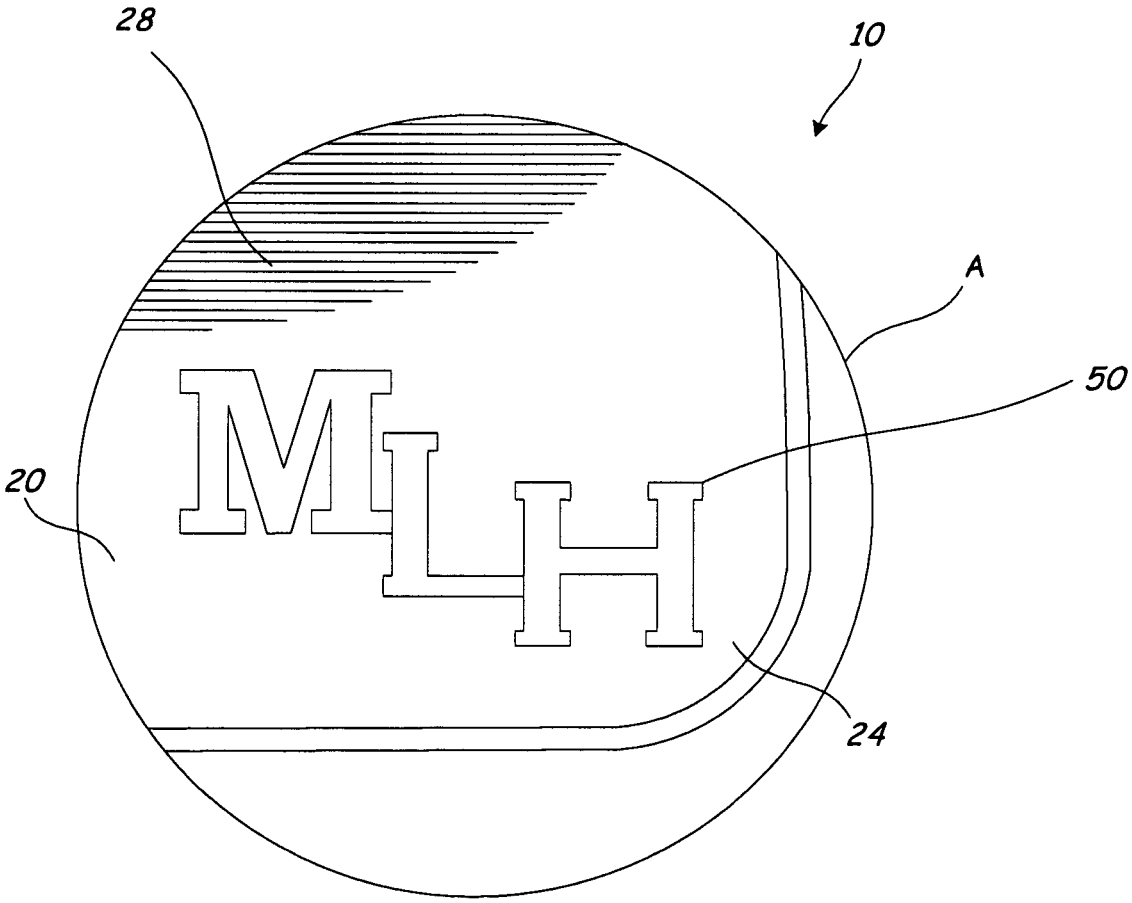
FIG. 7 is a left side view of a saddle pad display system according to an embodiment of the present invention.

Referring now to FIG. 7, a left side view of a saddle pad display system 10 is shown. The saddle pad 20 is shown close up in view A. The saddle pad 20 is shown from the left side 24, displaying the outer pad surface 28 and an equine jewelry monogram 50.

Figure 8:
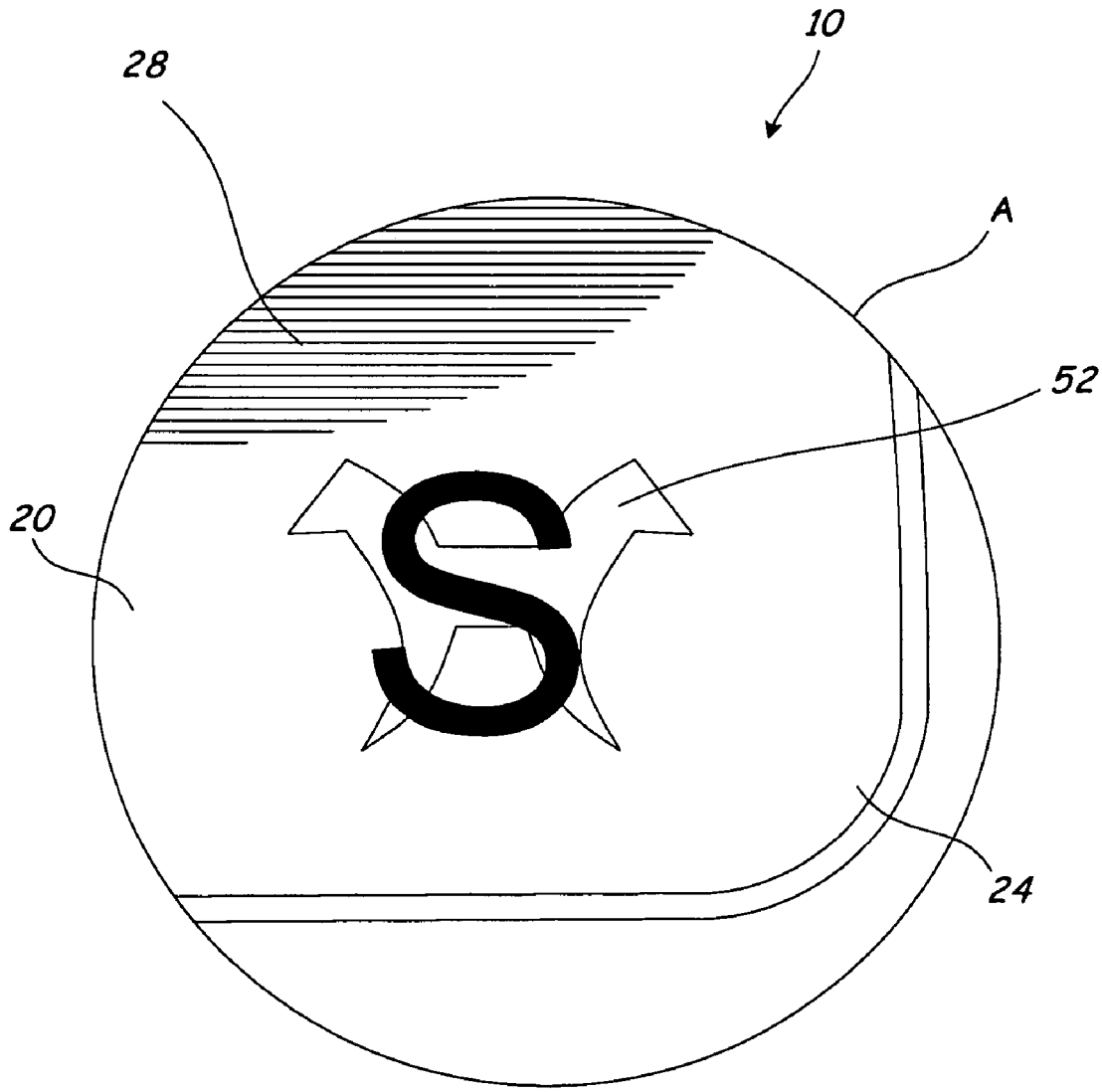
FIG. 8 is a left side view of a saddle pad display system according to an embodiment of the present invention.

Referring now to FIG. 8, a left side view of a saddle pad display system 10 is shown. The saddle pad 20 is shown close up in view A. The saddle pad 20 is shown from the left side 24, displaying the outer pad surface 28 and an equine jewelry breed logo 52.

Figure 9:
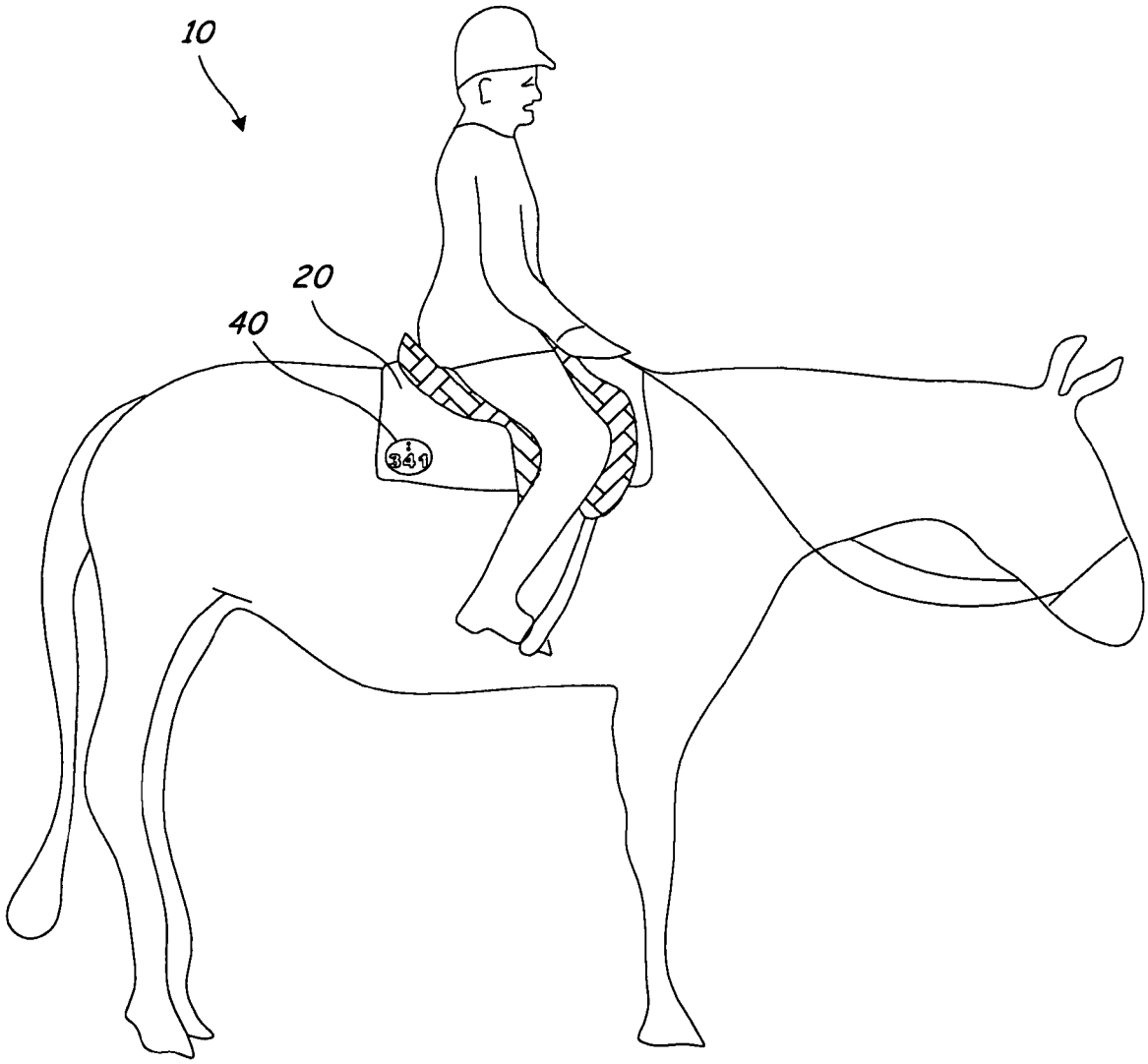
FIG. 9 is a right side view of a saddle pad display system according to an embodiment of the present invention.

Referring now to FIG. 9, a right side view of a saddle pad display system 10 is shown. The saddle pad 20 is shown placed upon a horse and located between the horse underneath and a saddle and rider above. The saddle pad display system 10 is shown illustrating an exhibitor number tag 40. Not shown is the fact that an exhibitor number tag 40 is placed of each side of the saddle pad 20, such that judges in a competition or exhibition may easily ascertain the horse and rider number.

Although the present invention has been illustrated and described with reference to preferred embodiments and examples thereof, it will be readily apparent to those of ordinary skill in the art that other embodiments and examples may perform similar functions and/or achieve similar results. For example: there are varying distances by which the display holes 22 may be placed apart; there exists a plethora of display items that might be displayed using the saddle pad display system 10; the display holes 22 might be placed in varying locations on the saddle pad 20; the display holes 22 may be cut at varying lengths to accommodate varying widths of metal clips 42 associated with each display item; and there exist various means by which a metal clip 42 might be attached to the back of an exhibitor number tag 40 or piece of equine jewelry 50 or 52, or the like. All such equivalent embodiments and examples are within the spirit and scope of the invention and are intended to be covered by the following claims.

What is claimed is:

1. A saddle pad display system, comprising:

a saddle pad, the saddle pad having a left side and a right side and further having an outer pad surface and an inner pad surface;

a plurality of display holes cut and sewn into the saddle pad, the depth of the display holes continuing throughout the entire thickness of the saddle pad;

a retaining sleeve attached to the inner pad surface and located centrally between a pair of display holes located on each side of the saddle pad; and a display item, the display item having a clip by which the display item may be securely attached to the saddle pad;

whereby the clip on the back of the display item is inserted into a display hole on one side of the saddle pad, extending from the outer pad surface, through the display hole, and through the inner pad surface, the clip being further inserted through retaining sleeve located on the inner pad surface of the saddle pad.

2. The saddle pad display system of claim 1, whereby the clip on the back of the display item is inserted into an upper display hole on one side of the saddle pad, extending from the outer pad surface, through the display hole, and through the inner pad surface, the clip being further inserted through retaining sleeve located on the inner pad surface of the saddle pad and located centrally between a pair of display holes and then inserted through a lower display hole on the same side of the saddle pad.

3. The saddle pad display system of claim 1, wherein the saddle pad is further comprised of a layer of fleece on the underside of the saddle pad, attached to the inner pad surface and located between the saddle pad and a horse.

4. The saddle pad display system of claim 1, wherein the clip is attached to the display item by a means comprised of using clip grommets.

5. The saddle pad display system of claim 1, wherein the metal clip is attached to the display item by a means comprised of gluing the clip to the back of the display item.

6. The saddle pad display system of claim 1, wherein two display holes used to hold a display item are located a distance apart from one another on a side of the saddle pad within a range of one and three eighths inches and one and five eighths inches.

7. The saddle pad display system of claim 1, wherein the retaining sleeve is comprised of a soft fabric.

8. The saddle pad display system of claim 1, wherein the retaining sleeve is comprised of fleece.

9. The saddle pad display system of claim 1, wherein the display item is an exhibitor number tag.

10. The saddle pad display system of claim 1, wherein the display item is a piece of equine jewelry comprised of a breed logo.

11. The saddle pad display system of claim 1, wherein the display item is a piece of equine jewelry comprised of a monogram.

12. The saddle pad display system of claim 1, wherein the display item is a piece of equine jewelry comprised of a stable name.

13. The saddle pad display system of claim 1, wherein the display item is a piece of equine jewelry comprised of the name of a horse.

14. The saddle pad display system of claim 1, wherein the display item is a piece of equine jewelry comprised of the name of an owner of a horse.

15. The saddle pad display system of claim 1, wherein there is only one display hole located on each side of the saddle pad.

16. A method of manufacturing a saddle pad display system comprising the steps of:

cutting a plurality of display holes into a saddle pad, the display holes being cut one on each side of the saddle pad;

sewing around the circumference of each cut display hole to protect the outer pad surface and inner pad surface comprising the saddle pad from tattering or unraveling; and sewing a retaining sleeve onto the inner pad surface of each side of the saddle pad, the retaining sleeve being located below the display hole on each side of the saddle pad.

17. A method of manufacturing a saddle pad display system comprising the steps of:

cutting a plurality of display holes into a saddle pad, the display holes being cut in pairs, one pair on each side of the saddle pad, and the display holes being placed apart at a predetermined distance;

sewing around the circumference of each cut display hole to protect the outer pad surface and inner pad surface comprising the saddle pad from tattering or unraveling; and sewing a retaining sleeve onto the inner pad surface of each side of the saddle pad, the retaining sleeve being located centrally between each pair of display holes on each side of the saddle pad.

* * * * *